US007591670B2

(12) United States Patent
Chen et al.

(10) Patent No.: US 7,591,670 B2
(45) Date of Patent: Sep. 22, 2009

(54) CONNECTOR DEVICE HAVING COUNTER THEREOF

(75) Inventors: Xiao-Zhu Chen, Shenzhen (CN); Zhen-Xing Ye, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 335 days.

(21) Appl. No.: 11/309,882

(22) Filed: Oct. 17, 2006

(65) Prior Publication Data

US 2008/0057789 A1 Mar. 6, 2008

(30) Foreign Application Priority Data

Sep. 1, 2006 (CN) ..... 2006-10062443

(51) Int. Cl.
*H01R 3/00* (2006.01)

(52) U.S. Cl. ..... 439/490; 340/568.4; 439/910

(58) Field of Classification Search ..... 439/517, 439/61, 631, 488–491, 910; 340/656, 568.4
See application file for complete search history.

(56) References Cited

U.S. PATENT DOCUMENTS 4,875,152 A * 10/1989 Foster ..... 363/146
4,901,007 A * 2/1990 Sworm ..... 324/110
5,225,816 A * 7/1993 Lebby et al. ..... 340/653
5,357,076 A * 10/1994 Blankenship ..... 219/121.54
5,811,966 A * 9/1998 Lee ..... 324/157
6,095,850 A * 8/2000 Liu ..... 439/488
6,344,748 B1 * 2/2002 Gannon ..... 324/542
6,555,990 B1 * 4/2003 Yang ..... 320/113
6,993,417 B2 * 1/2006 Osann, Jr. ..... 700/291
2002/0149502 A1 * 10/2002 Goss ..... 340/870.07
2005/0047030 A1 * 3/2005 Lee ..... 361/1

* cited by examiner

*Primary Examiner*—Neil Abrams
(74) *Attorney, Agent, or Firm*—Wei Te Chung

(57) ABSTRACT

A connector device having a counter thereof includes a connector, a micro control unit, an encoder, a display drive unit, and a display unit. The connector provides a power signal to the micro control unit when plugged an electrified device. The micro control unit outputs data and clock signals to the display drive unit to make the display drive unit count plug-in times of the connector, and also outputs a drive signal to the encoder after receiving the power signal. The encoder encodes the drive signal and outputs corresponding signals to the display drive unit to make the display drive unit control the display unit to display a count of plug-in times of the connector.

9 Claims, 3 Drawing Sheets

CONNECTOR DEVICE HAVING COUNTER THEREOF

FIELD OF THE INVENTION

The present invention relates to connectors, and more particularly to an electrical connector having a counter.

DESCRIPTION OF RELATED ART

An electrical connector is a device for joining electrical circuits together. Most electrical connectors provide an electrical connection that can be easily established and separated, and connectors are also available to facilitate permanent connections. There are hundreds of types of electrical connectors used in the fields of peripheral equipment, communication devices, and consumer products and so on. Quality of the electrical connectors is quite important for transmission reliability of signals therein.

Plug and socket connectors are usually made up of a male plug and a female socket. A plug generally has one or more pins or prongs that are insertable into one or more openings of a mating socket. The connection between the mating plug and socket must be sufficiently tight to make a good electrical connection. Generally, a cable with two plug connectors at two terminals thereof is needed to connect two different electronic components for testing electrical connection thereof. For testing, one of the plug connectors is inserted into the corresponding socket connector of one of the electronic components. Another plug connector is plugged into and pulled out of the other socket connector repeatedly. Typically, the number of times the plug is inserted and removed is counted manually, resulting in human error.

What is desired, therefore, is a connector device having a counter thereof that can display a count of plug-in times of the connector.

SUMMARY OF THE INVENTION

In one preferred embodiment, a connector device having a counter thereof includes a connector, a micro control unit, an encoder, a display drive unit, and a display unit. The connector provides a power signal to the micro control unit when plugged an electrified device. The micro control unit outputs data and clock signals to the display drive unit to make the display drive unit count plug-in times of the connector, and also outputs a drive signal to the encoder after receiving the power signal. The encoder encodes the drive signal and outputs corresponding signals to the display drive unit to make the display drive unit control the display unit to display a count of plug-in times of the connector.

Other advantages and novel features will become more apparent from the following detailed description of preferred embodiments when taken in conjunction with the accompanying drawings, in which:

DETAILED DESCRIPTION OF THE INVENTION

Figure 1:
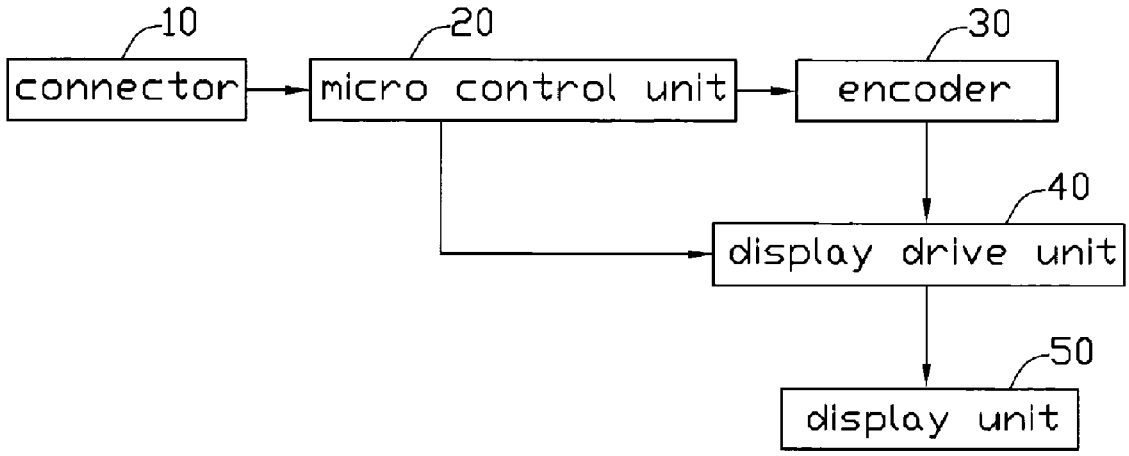
FIG. 1 is a block diagram of a connector device having a counter thereof in accordance with a preferred embodiment of the present invention.
Figure 2:
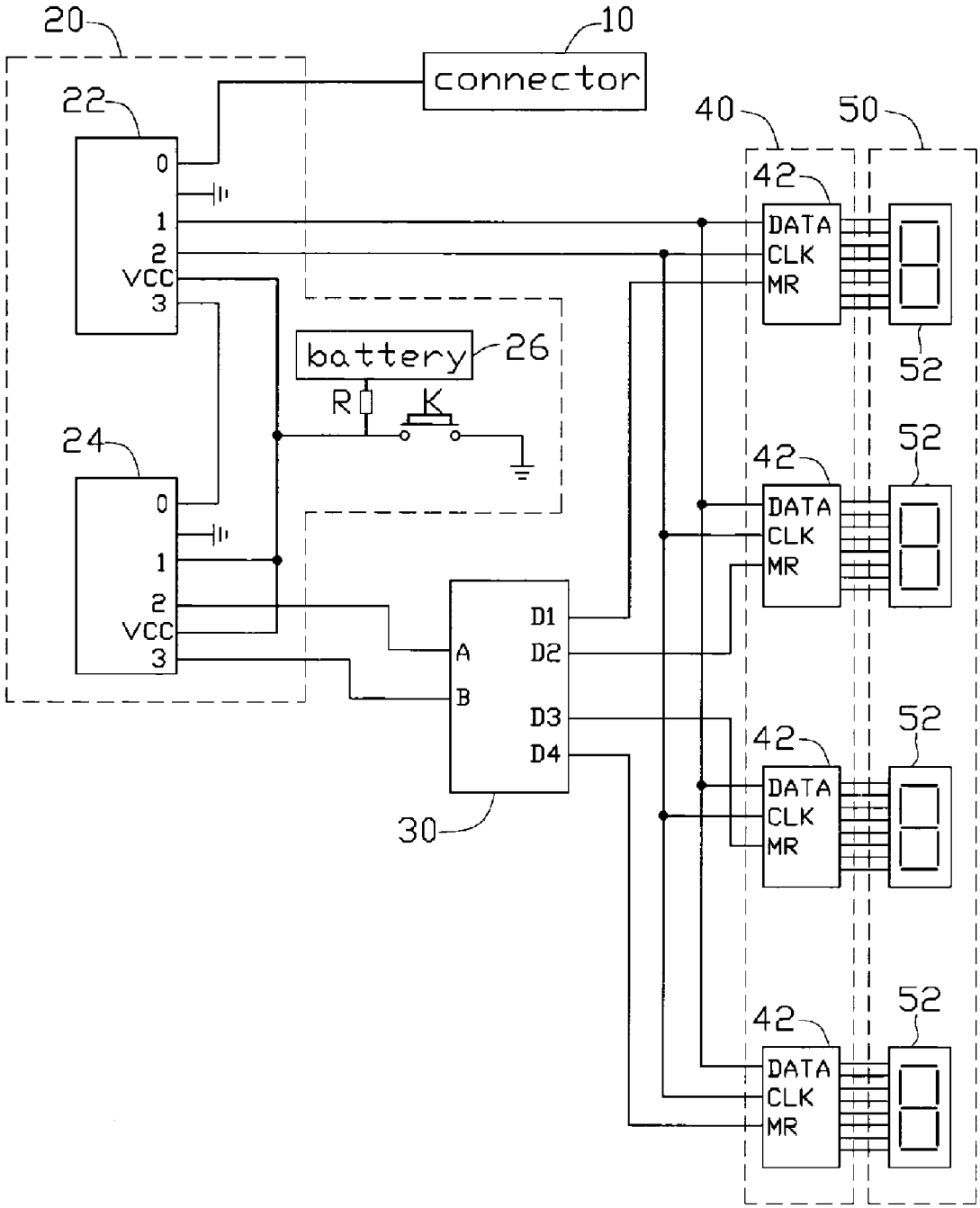
FIG. 2 is a circuit diagram of FIG. 1.
Figure 3:
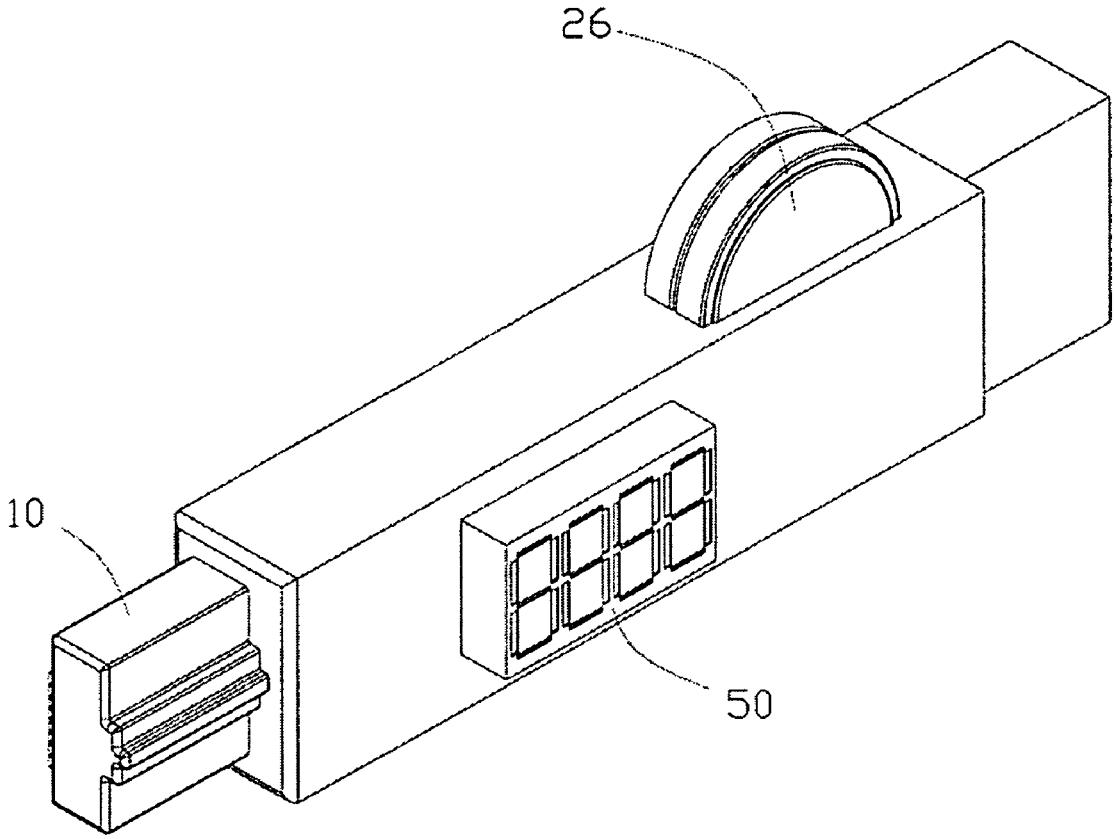
FIG. 3 is a schematic diagram of FIG. 1.

Referring to FIGS. 1 to 3, a connector device in accordance with a preferred embodiment of the present invention includes a connector 10, a micro control unit 20, an encoder 30, a display drive unit 40, and a display unit 50. The micro control unit 20, encoder 30, display drive 40, and display unit 50 are incorporated to the connector 10. The connector 10, encoder 30, and the display drive unit 40 are electrically connected to the micro control unit 20. The encoder 30 is electrically connected to the display unit 50 via the display drive unit 40. The micro control unit 20 controls the display unit 50 to display a number of times the connector 10 has been plugged-in.

The micro control unit 20 includes a first micro-controller 22, a second micro-controller 24, a battery 26, a resistor R, and a reset switch K. In the preferred embodiment of the present invention, both the first micro-controller 22 and the second micro-controller 24 are PIC10F200s produced by Microchip Corporation. According to written programs of the micro control unit 20, a detecting pin 0 of the first micro-controller 22 is connected to a power pin of the connector 10 for receiving a power signal from the connector 10. A data exchange pin 3 of the first micro-controller 22 outputs an actuating signal to a data exchange pin 0 of the second micro-controller 24 for controlling the second micro-controller 24 to output a drive signal to the encoder 30. Power pins VCC of both the first micro-controller 22 and the second micro-controller 24 are coupled to the battery 26 via the resistor R. A reset pin 1 of the second micro-controller 24 is grounded via the reset switch K.

The encoder 30 is a 74139 2-4 encoder. Input pins A, B of the encoder 30 are respectively coupled to encode pins 2, 3 of the second micro-controller 24 to receive the drive signal. The encoder 30 then encodes the drive signal and outputs a set of encoded signals to the display drive unit 40.

The display drive unit 40 includes four 8-bit serial input/parallel output shift-registers 42. In this embodiment, the shift-registers 42 are 74164 chips. The shift-registers 42 can transform serial signals into parallel signals. A DATA pin and a CLK pin of each shift-register 42 are respectively connected to data pin 1 and clock pin 2 of the first micro-controller 22. Data and clock signals from the first micro-controller 22 can make the display drive unit 40 to count plug-in times of the connector 10. Selective pins MR of the shift-registers 42 are respectively connected to input pins D1, D2, D3, and D4 of the encoder 30. The display drive unit 40 transforms the encoded signals from the encoder 30 into signals acceptable by the display unit 50 and then drives the display unit 50 to show a number of times the connector 10 has been plugged-in.

The display unit 50 includes four numeric light emitting diode (LED) indicators 52. Each indicator 52 is connected to an output pin of the corresponding shift-register 42. The indicators 52 are located side by side on the surface of the connector device.

Before testing, the first, and second micro-controllers 22, 24 are programmed and tested. The connector device is reset by the reset switch K if the first, and second micro-controllers 22, 24 test good.

In use, every time the connector 10 is plugged into an electrical device which is electrified, the connector 10 receives the power signal. The first micro-controller 22 then receives the power signal from the connector 10 and outputs the actuating signal to the second micro-controller 24. The first micro-controller 22 also outputs the data and clock signals to the display drive unit 40 to make the display drive unit 40 count. The second micro-controller 24 outputs the drive signal to the encoder 30 after receiving the actuating signal. The encoder 30 encodes the drive signal and outputs the encoded signals to the display drive unit 40. According to the encoded signals, the display drive unit 40 controls the display unit 50 to show a counting result, that is, the number of plug-in times of the connector 10. It is clear that the connector device is accurate in counting the number of plug-in times of the connector 10.

It is known that the micro control unit 20 also can be a signal microprocessor chip which has enough pins for any programming required.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment.

What is claimed is:

1. A connector device having a counter thereof, comprising:

a connector for receiving a power signal every time the connector is plugged into an electrified device;

a micro control unit for outputting data, clock, and drive signals after receiving the power signal from the connector, wherein the micro control unit comprises a first micro-controller, a second micro-controller, a battery, a resistor, and a reset switch; a detecting pin of the first micro-controller is connected to a power pin of the connector for collecting the power signal; a data exchange pin of the first micro-controller is for outputting an actuating signal to a data exchange pin of the second micro-controller for controlling the second micro-controller to output the drive signal; data and clock pins of the first micro-controller are for outputting data and clock signals; power pins of both the first micro-controller and the second micro-controller are coupled to the battery via the resistor; a reset pin of the second micro-controller is grounded via the reset switch;

an encoder for receiving and encoding the drive signal from the second micro-controller, and then outputting encoded signals;

a display drive unit for counting number of times the connector has been plugged-in, the number of times adding one every time the display drive unit receiving the data and clock signals from the second micro-controller, wherein the display drive unit comprises a plurality of serial input/parallel output shift-registers, date and clock pins of each shift-register are connected to the data and clock pins of the first micro-controller, and the shift-registers count the number of times the connector has been plugged-in, after receiving the data and clock signals from the first micro-controller; and a display unit displaying the number of times the connector has been plugged-in, after the display drive unit receiving the encoded signals from the encoder.

2. The connector device as claimed in claim 1, wherein numbers of the shift-registers are four.

3. The connector device as claimed in claim 1, wherein the display unit comprises a plurality of numeric light emitting diode (LED) indicators, and the display drive unit controls the indicators to display the number of times the connector has been plugged-in.

4. The connector device as claimed in claim 3, wherein the indicators are located side by side on the surface of the connector device.

5. The connector device as claimed in claim 1, wherein the micro control unit, encoder, display drive unit, and display unit are incorporated to the connector.

6. A connector device comprising:

a connector receiving a power signal every time the connector is plugged into an electrified device;

a micro control unit electrically connected to the connector, wherein the micro control unit comprises a first micro-controller, a second micro-controller, a battery, a resistor, and a reset switch; a detecting pin of the first micro-controller is connected to a power pin of the connector for collecting the power signal; a data exchange pin of the first micro-controller is for outputting an actuating signal to a data exchange pin of the second micro-controller for controlling the second micro-controller to output a drive signal; data and clock pins of the first micro-controller are for outputting data and clock signals; power pins of both the first micro-controller and the second micro-controller are coupled to the battery via the resistor; a reset pin of the second micro-controller is grounded via the reset switch;

an encoder electrically coupled to the second micro-controller;

a plurality of shift-registers electrically coupled to both the second micro-controller and the encoder; and a plurality of indicators electrically connected to the shift-registers;

wherein the second micro-controller outputs data and clock signals to the shift-registers after receiving the power signal from the connector to make the shift-registers count plug-in times; the second micro-controller outputs drive signals to the encoder, and the encoder outputs encoded signals to the shift-registers after receiving the drive signal to make the indicators display the number of times the connector has been plugged-in.

7. The connector device as claimed in claim 6, wherein the shift-registers are serial input/parallel output.

8. The connector device as claimed in claim 6, wherein numbers of the shift-registers are four.

9. The connector device as claimed in claim 6, wherein the indicators are numeric light emitting diode (LED) indicators located side by side on the surface of the connector device.

* * * * *